United States Patent [19]

Cuschera

[11] 4,103,372

[45] Aug. 1, 1978

[54] POP UP DRAIN FITTING

[76] Inventor: Casper Cuschera, 800 Durham Rd., Fremont, Calif. 94538

[21] Appl. No.: 773,138

[22] Filed: Feb. 28, 1977

[51] Int. Cl.[2] ..... A47K 1/14; E03C 1/26

[52] U.S. Cl. ..... 4/286; 4/287; 4/295

[58] Field of Search ..... 4/287, 286, 295, 290, 4/289; 251/74, 229, 254, 227, 58

[56] References Cited

U.S. PATENT DOCUMENTS

| | | | |
|---|---|---|---|
| 3,366,980 | 2/1968 | Petursson et al. | 4/295 |
| 3,380,081 | 4/1968 | Eilertson et al. | 4/295 |
| 3,468,512 | 9/1969 | Politz | 251/74 |
| 3,771,177 | 11/1973 | Rogers et al. | 4/287 |
| 3,995,333 | 12/1976 | Stephens | 4/286 |
| 4,007,500 | 2/1977 | Thompson et al. | 4/295 |

*Primary Examiner*—Henry K. Artis
*Attorney, Agent, or Firm*—Harris Zimmerman

[57] ABSTRACT

A selectively sealing drain fitting includes a tubular drain body having a spider in the lower end thereof. An upwardly extending rectangular post is joined to the center of the spider, and is provided with a lateral slot in one face thereof and an oblique camming surface directly superjacent thereto. A drain sealing cover is provided with a downwardly depending hollow tubular portion which is received about the rectangular post and maintained in an eccentric disposition thereabout by an eccentric dog extending laterally from the upper end of the post. A compression spring disposed within the tubular portion of the drain cover biases the cover upwardly, and a latch pin extending laterally through the tubular portion of the cover engages the camming surfaces and the slot in the post in detent fashion. A laterally extending spring within the post biases a ball which is axially aligned with the eccentric dog to impinge on the inner surface of the tubular portion of the cover and maintain exact parallel eccentric alignment of the tubular portion and the rectangular post.

1 Claim, 5 Drawing Figures

POP UP DRAIN FITTING

BACKGROUND OF THE INVENTION

The following U.S. Pat. Nos. exemplify the state of the art of selectively self-sealing drain valves:

3,771,177
3,428,295
3,380,081
3,366,980
2,173,529

It is well known in the art to provide self-sealing drains, particularly in household use for bathtubs, sinks, and the like. These self-sealing drains are generally provided with a remote actuator which is linked to the drain itself by a lever or chain arrangement. Over a period of years, these drains and the lever or chain linkages undergo erosion and wear, and eventually fail. Due to the fact that the linkage is usually located within a wall or beneath a bathtub or sink, it is usually quite difficult to gain access to the linkage for the purpose of making repairs. Because of the expense involved of such repairs, a homeowner often avoids such costs by providing a replacement sealable drain valve which does not require a remote actuator.

Generally speaking, these replacement drain valves may be installed in the body of the original drain valve, and often include a drain cover which translates axially to seal the top opening of the replacement valve. The prior art devices have often relied on the resiliency of a rubber boot or the like to bias the drain cover upwardly to an open disposition. Experience has shown that rubber or similar resilient materials loose their elasticity and resiliency rather quickly when they are exposed to repeated cycles of wetting and drying. The corrosive effects of the detergents found in soaps and shampoos enhance this effect. When the resilient material fails, the replacement valve itself must again be replaced.

Also, the prior art devices generally include a latch detent mechanism which secures the drain cover in a closed position. To release the drain cover, it is necessary to press one portion thereof to disengage the latch. For the uninitiated and uninformed, it is an inconvenience to attempt to determine which portion of the cover must be pressed to open the drain valve.

SUMMARY OF THE PRESENT INVENTION

The present invention generally comprises a selectively sealable drain valve which may be operated with greater ease than those known in the prior art, and which does not rely on elastomeric material for its spring biasing effect. Thus the drain valve has fewer maintenance problems and a longer useful life.

The drain valve of the present invention generally includes cylindrical drain body which is provided with a radially extending flange at the upper end thereof. A disc-like cover member is disposed concentrically to the flange and in superjacent relationship thereto, and an annular gasket extending radially from the cover member is adapted to impinge on the flange and seal the valve.

The lower end of the valve body is provided with a spider to which an upwardly extending rectangular post is secured. The rectangular post is slidably secured within a tubular member depending from the cover member of the valve assembly. A rectangular compression spring interposed between a counterbore and the top of the rectangular post and the cover member biases the cover member upwardly to the open position.

The rectangular post is provided with an obliquely extending camming surface on one side thereof, the lower end of the camming surface extending to the lip of a laterally disposed detent slot. A latch pin extending chordally through the tubular member is disposed to ride on the camming surface, and also to engage the detent slot.

Extending from the upper end of the rectangular post, in opposition to the camming surface and detent slot, is an eccentric lip. The lip maintains the tubular member in eccentric relationship with the rectangular post. The post also includes a laterally disposed hole, in which a biasing spring and ball are disposed. The ball impinges on the interior bore of the tubular member to maintain the axis of the tubular member parallel to and laterally offset from the axis of the rectangular post.

DESCRIPTION OF THE PREFERRED EMBODIMENT

Figure 3:
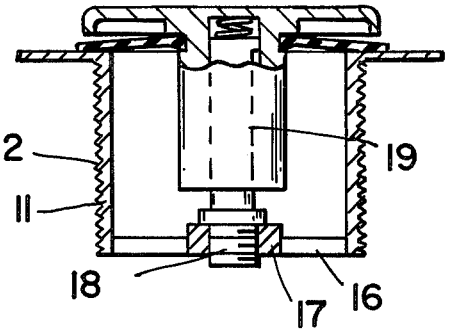
FIG. 3 is a partially sectioned elevation of the drain valve of the present invention.

The selectively sealable drain valve of the present invention generally includes a tubular body member 11 which is provided with external threads 12. The body member 11 includes an axially disposed bore 14, and a radially outwardly extending flange 13 extending from the upper end of the body member. At the lower end of the body member 11 there is secured a spider 16 which supports an axially disposed ring 17. The ring 17 is provided with a concentrically disposed threaded hole, as shown in FIG. 3.

Figure 1:
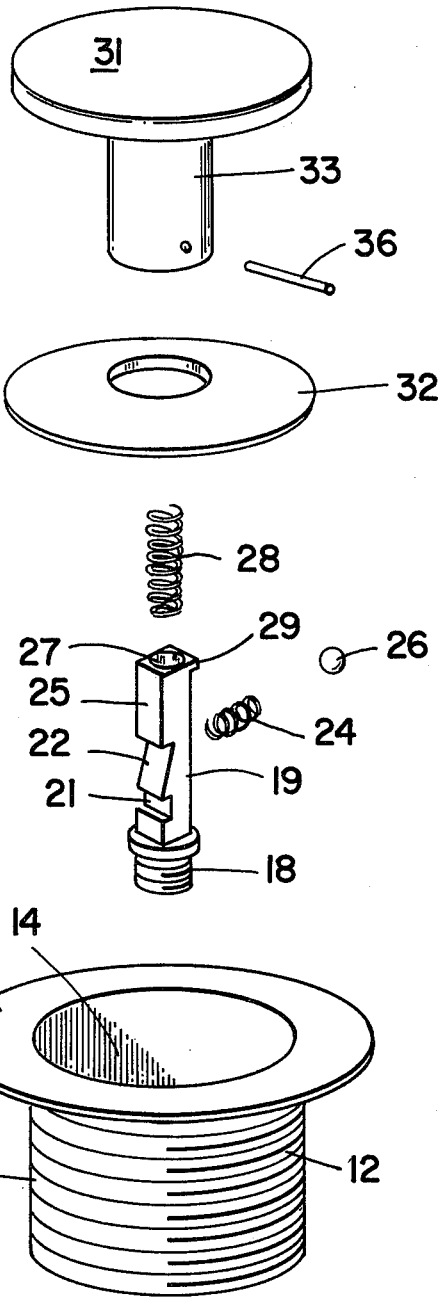
FIG. 1 is an exploded view of the selectively sealable drain valve of the present invention.
Figure 2:
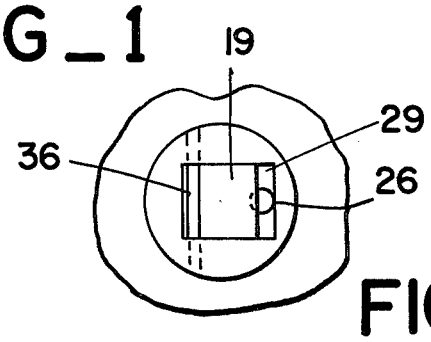
FIG. 2 is a laterally cross-sectional, detailed view of the rectangular post and tubular member of the present invention.

The drain valve also includes a generally rectangular post 19 which includes a lower threaded end 18 adapted to be secured in the threaded hole of the ring 17. One vertical surface 25 of the rectangular post 19 is provided with a laterally extending detent slot 21. The same vertical surface is also provided with a ramped camming surface 22 extending from the upper lip of the slot 21 upwardly and obliquely inwardly, as shown in FIG. 1.

Figure 4:
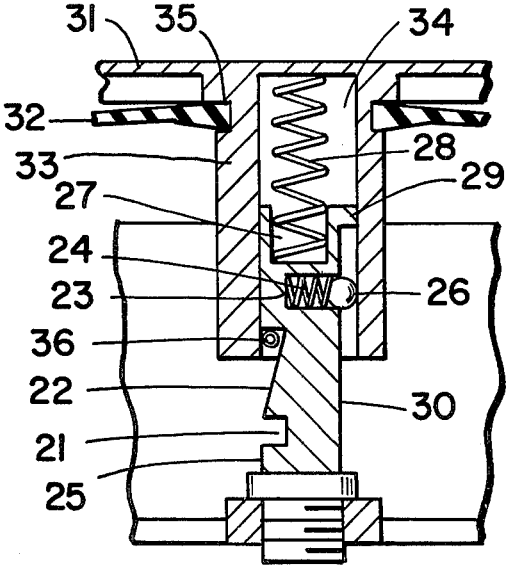
FIG. 4 is a cross-sectional elevation of the central portion of the present invention, shown in the open disposition.
Figure 5:
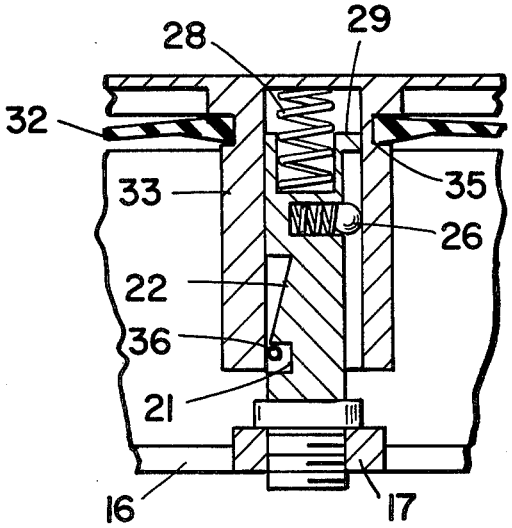
FIG. 5 is a cross-sectional elevation of the central portion of the present invention, shown in the closed disposition.

The vertical surface 30 of the rectangular post, which is opposed to the vertical surface 25, is provided with a radially extending hole 23. Disposed in the hole 23 is a helical compression spring 24, and a ball 26. The spring 24 biases the ball 26 radially outwardly, for reasons which will be explained in the following description. Extending from the upper end of the surface 30 is a lip 29. As shown in FIGS. 1, 4, and 5, the lip 29 extends laterally outwardly only from the surface 30.

Disposed in the top of the rectangular post 19 is a center bore 27. Seated in the bore 27 is a helical compression spring 28, which extends upwardly from the rectangular post. The function of the spring 28 will be made apparent in the following description.

The drain valve of the present invention also includes a generally disc-like drain cover 31. Extending downwardly from the drain cover and disposed concentric with the axis thereof is a tubular member 33. The tubular member 33 is provided with a reduced diameter annulus 35, shown in FIGS. 4 and 5. An annular sealing gasket 32 is resiliently secured in the annulus 35, with the peripheral portion thereof angled slightly downwardly with respect to the cover 31. The outer diameter of the gasket 32 is greater than the diameter of the bore 14 of the drain valve body member, and the peripheral edge of the gasket is adapted to impinge on the flange 13 in sealing fashion to prevent any flow through the bore 14 of the drain valve.

As shown in FIGS. 3, 4, and 5, the chamber 34 within the tubular member 33 receives the rectangular post 19. The width of the post from side 25 to side 30 is less than the diameter of the chamber 34, and the tubular portion 33 is disposed parallel to the post 19 and laterally offset therefrom. The lip 29 extending from the side 30 of the post maintains the lateral offset of the tubular portion 33, and the spring biased ball 26 maintains the tubular portion in parallel alignment with the post 19. It may be appreciated, however, that the cover member 31 may be rocked or pivoted about the lip 29, the ball 26 being urged against the spring force of spring 24 into the hole 23.

A latch pin 36 is also provided in the lower end of the tubular member 33, extending along a chord through the chamber 34. The latch pin 36 is disposed adjacent to the camming surface 22, and is adapted to be retained in the detent slot 21, as shown in FIG. 5.

It may be understood that the compression of the spring 28 biases the cover 31 upwardly, so that the gasket 32 clears the flange 13 of the drain valve body by a substantial margin. In this configuration, there is free flow through the gap defined by the gasket 32 and the flange 13.

To close the drain valve and prevent fluid flow through the bore 14, the cover member is manually urged downwardly by pressure applied directly above the tubular member 33 or to a portion of the cover along a radius thereof opposed to lip 29. As the cover is depressed, the latch pin 36 rides the camming surface 22, causing the tubular member 33 to pivot slightly about the lip 29 and urge the ball 26 into its hole 23. As the latch pin 36 reaches the detent slot 21, the resilient urging of the spring 24 causes the latch pin to enter the slot 21, as shown in FIG. 5, locking the cover in the depressed position. The action of the spring 24 also causes the tubular member to reattain its parallel alignment with the rectangular post 19.

In this disposition, shown in FIG. 3, the peripheral rim of the gasket 32 impinges upon the flange 13. Thus the valve is sealed against any flow through the bore 14. It may be appreciated that any pressure loading due to liquid accumulating above the valve will merely increase the sealing action of the gasket 32.

To release the drain valve from the closed, depressed position shown in FIG. 5, the cover member is again depressed in the general area along a radii parallel with the lip 29. This action urges the ball 26 into the hole 23, and releases the latch pin 36 from the slot 21. The expansive force of the spring 28 then urges the cover member upwardly, opening the valve and allowing flow therethrough. The upward travel of the cover member is limited by the impingement of the latch pin 36 and the ledge defined by the upper extent of the camming surface 22.

It should be noted that the combined action of the springs 28 and 24 provide a very positive locking action, while permitting easy release of the latch pin from the detent slot 21. Furthermore, the springs 24 and 28 are not subject to the effect of aging and corrosion, as were the elastomeric resilient means known in the prior art. Thus, the present invention is longer lived than prior art devices, and will require less maintenance.

I claim:

1. In a drain valve including a drain body having a flow channel therethrough and a post extending azially through said flow channel, and a drain sealing cover provided with a tubular portion having a central passage receiving said post for slidable translation thereabout and radial clearance therefrom, detent means in one axially extending surface of said post for selectively securing said post and said tubular portion with said drain sealing cover sealing said flow channel, said detent means being disengageable by rocking said tubular portion about the upper end of said post, the improvement comprising first compression spring means for biasing said drain sealing cover upwardly to clear said flow channel; and resilient means for biasing said tubular portion radially to oppose said rocking disengagement of said detent means, said resilient means including a hole extending radially into said post, the opening of said hole being in opposed relationship to said one axially extending surface, a detent member disposed in said hole, and second compression spring means for biasing said detent member into impingement with said central passage of said tubular member.

* * * * *